US009765972B2

(12) United States Patent
Zink

(10) Patent No.: US 9,765,972 B2
(45) Date of Patent: Sep. 19, 2017

(54) FUEL INJECTORS FOR GAS TURBINE ENGINES

(71) Applicant: Delavan Inc, West Des Moines, IA (US)

(72) Inventor: Gregory Zink, Des Moines, IA (US)

(73) Assignee: Delavan Inc., Des Moines, IA (US)

( * ) Notice: Subject to any disclaimer, the term of this patent is extended or adjusted under 35 U.S.C. 154(b) by 364 days.

(21) Appl. No.: 14/609,957

(22) Filed: Jan. 30, 2015

(65) Prior Publication Data

US 2016/0223201 A1 Aug. 4, 2016

(51) Int. Cl.

| | |
|---|---|
| ***B05B 7/10*** | (2006.01) |
| ***F23R 3/28*** | (2006.01) |
| ***B05B 7/04*** | (2006.01) |
| ***B05B 1/08*** | (2006.01) |
| ***F23D 11/10*** | (2006.01) |
| ***F23D 11/24*** | (2006.01) |
| ***F23D 11/38*** | (2006.01) |

(52) U.S. Cl.

CPC ..... *F23R 3/28* (2013.01); *B05B 1/08* (2013.01); *B05B 7/04* (2013.01); *B05B 7/10* (2013.01); *F23D 11/10* (2013.01); *F23D 11/24* (2013.01); *F23D 11/38* (2013.01); *F23D 11/383* (2013.01); *F23R 3/286* (2013.01); *F23D 2212/00* (2013.01); *F23D 2212/203* (2013.01); *F23D 2213/00* (2013.01); *F23D 2900/00003* (2013.01); *F23D 2900/11101* (2013.01)

(58) Field of Classification Search

CPC .. F23R 3/28; F23R 3/286; F23R 3/283; F23D 11/10; F23D 11/24; F23D 11/38; F23D 11/383; B05B 7/10; B05B 7/04; B05B 1/08

USPC ..... 239/399, 403, 584, 589.1; 60/737, 740, 60/746

See application file for complete search history.

(56) References Cited

U.S. PATENT DOCUMENTS

| | | | | |
|---|---|---|---|---|
| 2,404,335 | A * | 7/1946 | Whittle | F23R 3/14 60/746 |
| 5,657,631 | A * | 8/1997 | Androsov | F23D 11/402 239/403 |
| 5,799,872 | A | 9/1998 | Nesbitt et al. | |
| 2012/0227408 | A1 | 9/2012 | Buelow et al. | |
| 2013/0214063 | A1 | 8/2013 | Ryon et al. | |
| 2014/0291418 | A1 | 10/2014 | Ruffing et al. | |

OTHER PUBLICATIONS

Extended Search Report issued Jul. 11, 2016 in connection with EP co-pending Application No. EP16153173.6.

* cited by examiner

*Primary Examiner* — Steven J Ganey

(74) *Attorney, Agent, or Firm* — Locke Lord LLP; Scott D. Wofsy; Christopher J. Cillié

(57) ABSTRACT

A fuel injector for a gas turbine engine includes a monolithic nozzle body that defines within its interior one or more fuel circuits. Each fuel circuit includes an inlet, an outlet orifice, a main passage fluidly coupling the inlet with the outlet orifice, and a branch passage connected to the main passage. The branch passage connects to the main passage downstream of the inlet and upstream of the outlet orifice to form an effective metering flow area that is smaller than the flow area of the outlet orifice.

13 Claims, 4 Drawing Sheets

FUEL INJECTORS FOR GAS TURBINE ENGINES

BACKGROUND OF THE INVENTION

1. Field of the Invention

The subject invention relates to fuel injectors for gas turbine engines, and more particularly, to fuel injectors having additively manufactured nozzle bodies.

2. Description of Related Art

Gas turbine engines commonly include a compressor section in fluid communication with a turbine section through a combustion section. Components within such engines can be subject to dynamic and static loads, corrosive environments, and high temperatures. As gas turbine engines generally must satisfy high demands with respect to reliability, weight, performance, economic efficiency and durability, components are generally formed using a forging process or casting process, or by machining. Forging is commonly used for components subject to dynamic loading, such as compressor and turbine rotor blades. Investment casting is commonly used for static components subject to high temperatures, such as compressor and stator vanes and combustor section components, such as fuel nozzles. Machining, such as from bar stock, is typically used for components with complex shapes like fuel injectors.

An alternative to forging, casting, and machining is additive manufacturing. Additive manufacturing can provide certain benefits to structures such as fuel injectors, such as the ability to form relatively complex structures and the ability to integrate within an integral structure components that otherwise would be assembled to a forged, cast, or machined structure.

Such conventional methods and systems generally have been considered satisfactory for their intended purpose. However, there remains a need for improved nozzle assemblies having fluid passages that are easy to make. The present disclosure provides a solution to this need.

SUMMARY OF THE INVENTION

A fuel injector for a gas turbine engine includes a monolithic nozzle body that defines within its interior a fuel circuit. The fuel circuit includes an inlet, an outlet orifice, a main passage fluidly coupling the inlet with the outlet orifice, and a branch passage connected to the main passage. The branch passage connects to the main passage downstream of the inlet and upstream of the outlet orifice to form an effective metering flow area that is smaller than the flow area of the outlet orifice.

In certain embodiments the branch passage can diverge from the main passage downstream of the inlet. The branch passage can diverge from the main passage at a diverging junction, and the main passage and branch passage can define flow axes that are angled relative to one another immediately downstream and adjacent to the diverging junction. The main passage flow axis can diverge from the branch passage flow axis at an acute angle immediately downstream of and adjacent to the diverging junction. The branch passage flow axis immediately downstream and adjacent to the diverging junction can be coaxial with the main passage flow axis immediately upstream and adjacent to the diverging junction. The main passage flow axis immediately downstream and adjacent to the diverging junction can be angled relative to the main passage flow axis upstream of the diverging junction.

In accordance with certain embodiments the branch passage can rejoin the main passage upstream of the outlet orifice. The branch passage can rejoin the main passage at a converging junction, and the branch passage can loop back on itself such that a flow axis of the branch passage intersects a flow axis of the main passage with an axial component opposing the main passage flow axis. The branch passage flow axis can intersect the main passage flow axis at an acute angle such that flow entering the main passage from the branch passage impinges flow through the main passage, opposing flow through the main passage, and forming an effective metering flow area within the converging junction that is smaller than the flow areas of the main passage, branch passage, and the outlet orifice.

It is also contemplated that in certain embodiments the fuel circuit can include a distribution header. The distribution header can be disposed within the nozzle body, and can fluidly couple the fuel circuit with the inlet. The fuel circuit can be a first fuel circuit, and a second fuel circuit can be defined within the nozzle body. The second fuel circuit can be similar in arrangement relative to the first fuel circuit, and can include a second outlet orifice that is fluidly coupled to the inlet through the distribution header. It is further contemplated that the nozzle body can be an additive nozzle body, and that interior surfaces within the nozzle body bounding the main passage and branch passages can have surface roughness that is greater than surfaces of air blast nozzle bodies with internal surfaces formed using casting and/or hydro-erosive grinding processes.

An air blast nozzle includes a fuel injector as described in claim 1. The fuel injector includes a prefilmer with an outlet circumferentially surrounding a tip fuel injector nozzle body.

The outlet orifice of the fuel circuit is disposed adjacent to the prefilmer such that fuel issuing from the outlet orifice flows across a surface of the prefilmer and atomized by air traversing the prefilmer.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
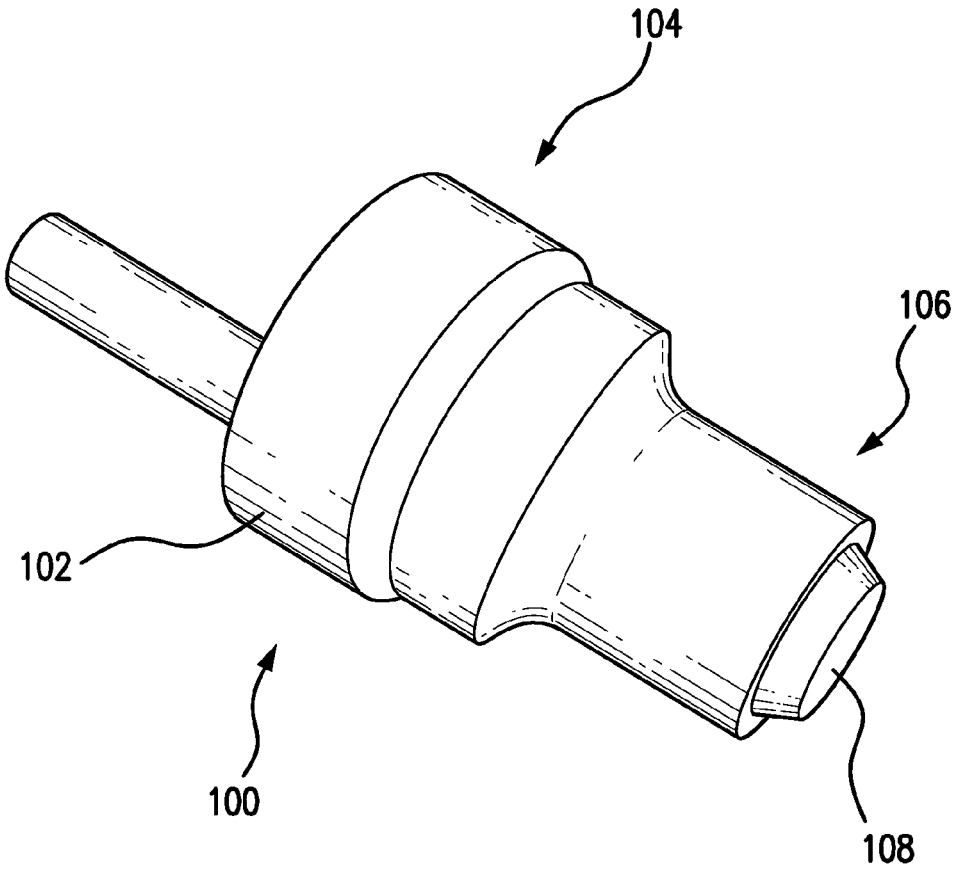
FIG. 1 is a perspective view of an exemplary embodiment of a fuel injector constructed in accordance with the present disclosure, showing a nozzle body with an inlet and outlet orifices.

Reference will now be made to the drawings wherein like reference numerals identify similar structural features or aspects of the subject disclosure. For purposes of explanation and illustration, and not limitation, a partial view of an exemplary embodiment of a fuel injector in accordance with the disclosure is shown in FIG. 1 and is designated generally by reference character 100. Other embodiments of fuel injectors in accordance with the disclosure, or aspects thereof, are provided in FIGS. 2-4, as will be described. The systems and methods described herein can be used for gas turbine engine, such as in aircraft main engines or auxiliary power units.

As shown in FIG. 1, fuel injector 100 includes a nozzle body 102 that extends axially between an inlet end 104 and an opposed outlet end 106. Nozzle body 102 is a monolithic nozzle body formed using an additive manufacturing process and includes a prefilmer 108 circumferentially surrounding nozzle body 102. As illustrated in FIG. 1, prefilmer 108 is integral with nozzle body 102 and formed using the same additive manufacturing process through which nozzle body 102 was formed. It is to be understood and appreciated that prefilmer 108 can be constructed as a separate element and coupled to nozzle body 102 using a joining operation, such as brazing or other suitable joining process.

Figure 2:
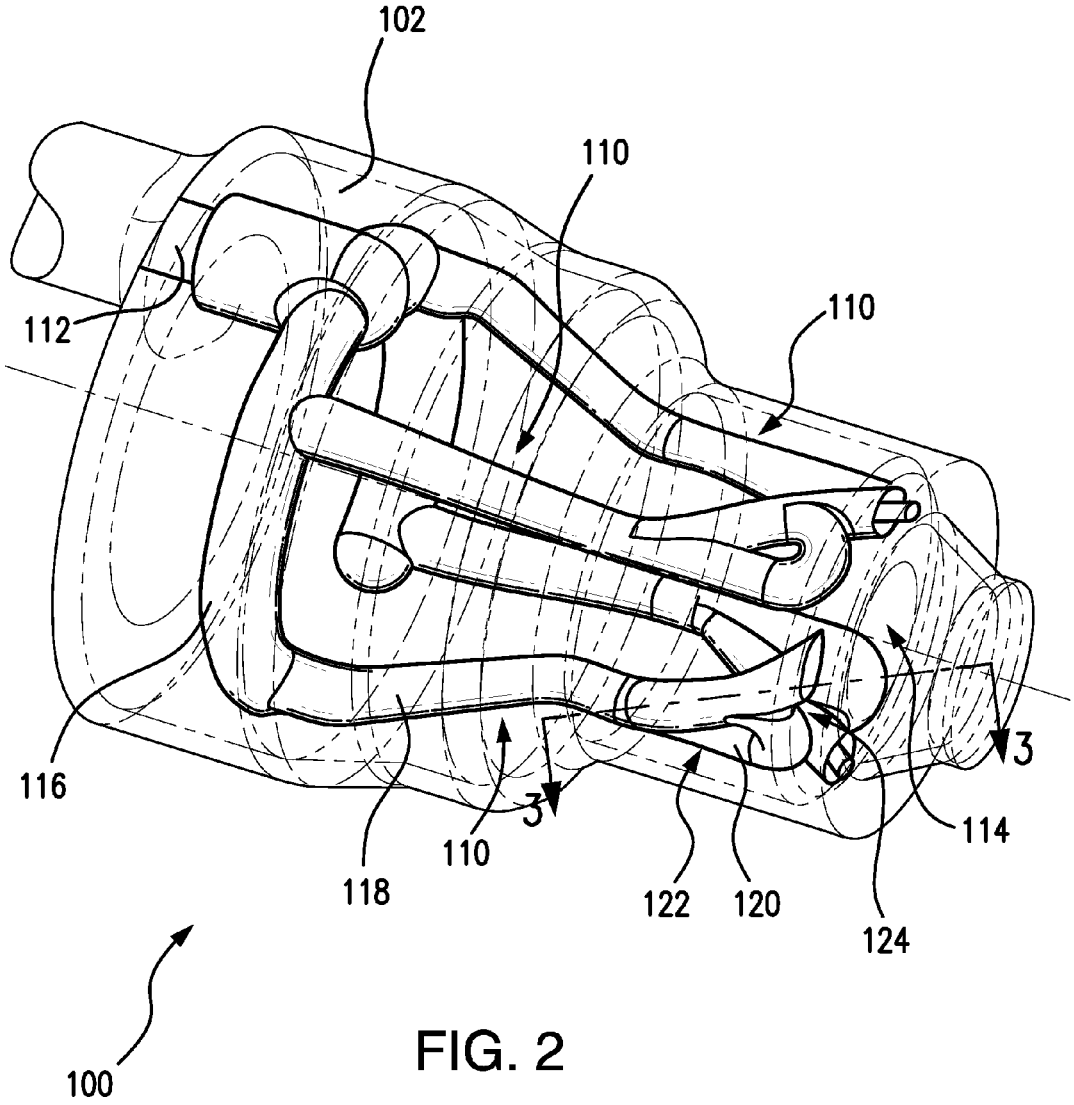
FIG. 2 is a transparent perspective view of the fuel injector of FIG. 1, showing fuel circuits defined within the interior of the nozzle body.

With reference to FIG. 2, an interior of nozzle body 102 is shown. Nozzle body 102 defines with its interior a fuel circuit 110. Fuel circuit 110 extends axially through nozzle body 102 between an inlet 112 and an outlet orifice 114. Inlet 112 is in fluid communication with outlet orifice 114 through a distribution header 116, a main passage 118, and a branch passage 120. Main passage 118 extends between distribution header 116 and outlet orifice 114, fluidly connecting distribution header 116 to outlet orifice 114. Branch passage 120 extends between a first end 122 and second end 124, first end 122 connecting to main passage 118 downstream of inlet end 104 and second send 124 connected to main passage 118 upstream of outlet orifice 114. In this respect branch passage 120 is connected in parallel with main passage 118 and fluidly connects distribution header 116 with outlet orifice 114.

Nozzle body 102 includes a plurality of fuel circuits 110. Each of the plurality of fuel circuits 110 is connected to distribution header 116 and includes a respective outlet orifice 114 each of which is in fluid communication with the main passage and branch passage of the fuel circuit. As illustrated in FIG. 2, nozzle body 102 defines within its interior four fuel circuits 110. It is to be understood and appreciated that embodiments of nozzle body 102 can define within its interior a greater number or smaller number of fuel circuits, as suitable for a given application.

For example, nozzle body 102 can define a single fuel circuit, two fuel circuits, or more than two fuel circuits as suitable for an intended application.

It is also to be understood and appreciated that the fuel circuits can trace a helical path within the interior of nozzle body 102 such that fuel issuing from outlet orifice 114 swirls about an issue axis A defined by nozzle body 102. The angle of passage is selected to create a predetermined spray angle for a fuel spray issuing from nozzle body 102, and the angle of the diverging and converging passages is selected to provide a predetermined flow rate for nozzle body 102.

Figure 3:
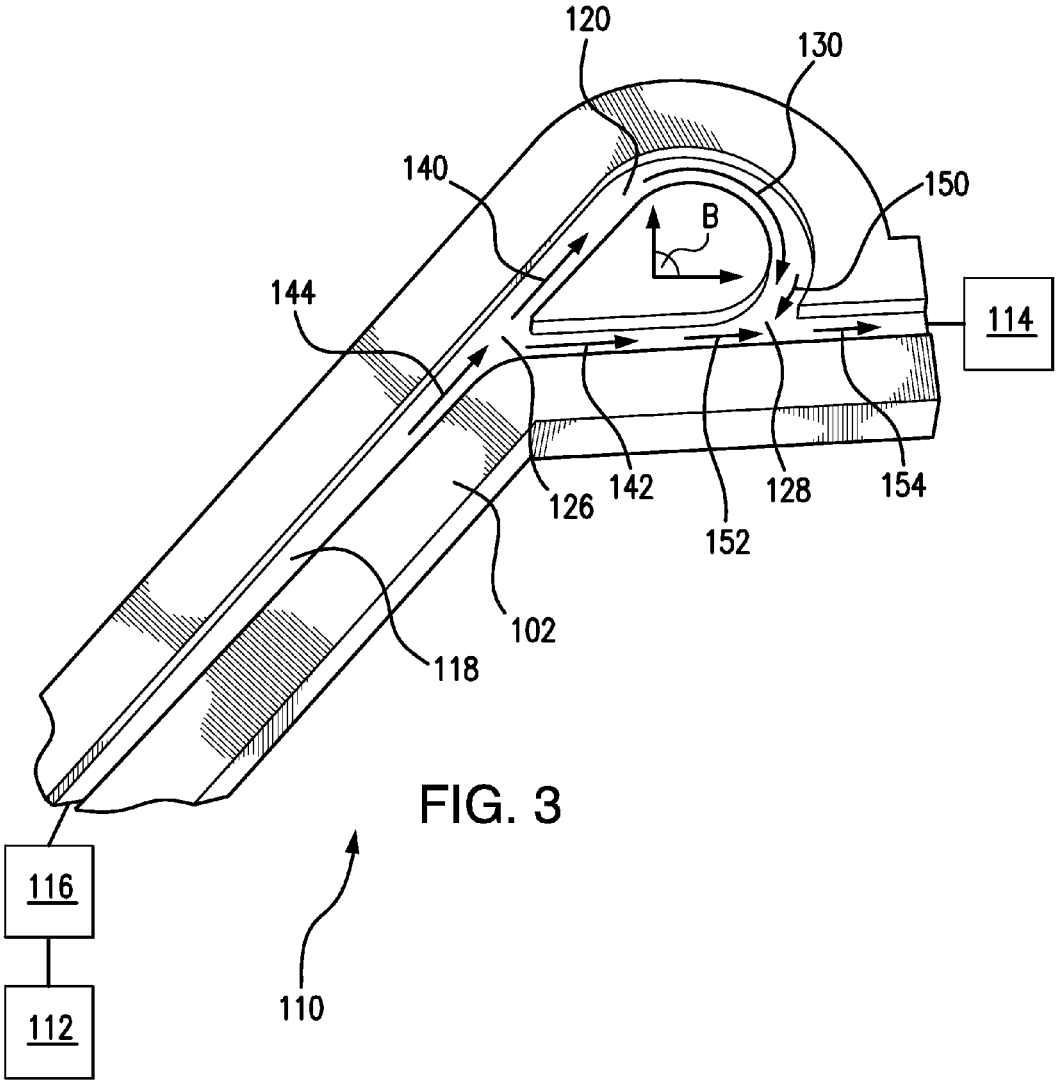
FIG. 3 is a schematic cross-sectional view of a fuel circuit defined within the nozzle body of FIG. 1, showing a branch passage coupled to a main passage and which rejoins the main passage at an impingement chamber.

With reference to FIG. 3, fuel circuit 110 is shown. Fuel circuit 110 is defined by nozzle body 102 (only a portion of which is shown) and includes main passage 118 and branch passage 120. Branch passage 120 diverges from main passage 118 at a diverging junction 126 and converges with converging junction 128. A turning or reversing segment 130 that loops back on itself fluidly couples diverging junction 126 with converging junction 128. Turning or reversing segment 130 changes the direction of fluid flow through nozzle body 102 such that a component of fluid flow through branch passage 120 opposes fluid flow through main passage 118. As illustrated, turning or reversing segment 130 includes an arcuate segment extending about an angular range B of more than about 90-degrees. Other arrangements are possible within the scope of the present disclosure.

Converging junction 126 is disposed between distribution header 116 and converging junction 126, and is downstream from inlet with respect to fluid flow through nozzle body 102. Immediately downstream and adjacent to diverging junction 126, branch passage 120 defines a flow axis 140 and main passage 118 defines flow axis 142. Flow axis 142 is angled with respect to flow axis 140, and as illustrated in FIG. 3, intersect one another at an acute angle within diverging junction 126 and upstream of the flow axis 140 and flow axis 142. Main passage 118 also defines a flow axis 144 disposed immediately upstream of and adjacent to diverging junction 126, flow axis 144 of main passage 118 being substantially coaxial to flow axis 140 of branch passage 120. As also illustrated in FIG. 3, flow axis 142 of main passage 118 intersects flow axis 144 at an obtuse angle within diverging junction 126 upstream of flow axis 142 and downstream of flow axis 144.

Converging junction 128 rejoins main passage 118 in converging junction 128. Converging junction 128 is disposed between outlet orifice 114 and diverging junction 126. In this respect substantially all the fluid entering main passage 120 from distribution header 116 traverses either main passage 118 or branch passage 120 between diverging junction 126 and converging 128 in a parallel fluid flow arrangement.

Branch passage 120 rejoins main passage 118 with a fluid flow component that opposes the direction of fluid flow through main passage 118. In this respect branch passage 120 defines a flow axis 150 immediate upstream and adjacent to converging junction 128. Flow axis 150 intersects a flow axis 152 defined by main passage 118 immediately upstream and adjacent to converging junction 128 at an obtuse angle. Flow rejoining main passage 118 from branch passage 120 along flow axis 150 impinges fluid flow through fluid circuit 110 and establishes an effective metering flow area that is less than the minimum flow area defined within fuel circuit 110 by nozzle body 102. This can have the effect of establishing a characteristic pressure drop function for fuel injector 100 that is dependent upon orientation of branch passage 120 relative to main passage 118, and decouples fuel injector performance from flow area geometry as typically relied upon in conventional fuel injectors.

In embodiments, branch passage 120 intersects main passage 118 at an angle such that flow entering the main passage 118 from branch passage 120 forms an effective metering flow area within converging junction 126 that is smaller than respective flow areas main passage 118, branch passage 120, and outlet orifice 114. This can reduce the sensitivity of the nozzle to internal geometry, and allows for construction of nozzle bodies using manufacturing processes that can leave surface artifacts (or roughness) that would otherwise be prohibitive.

Figure 4:
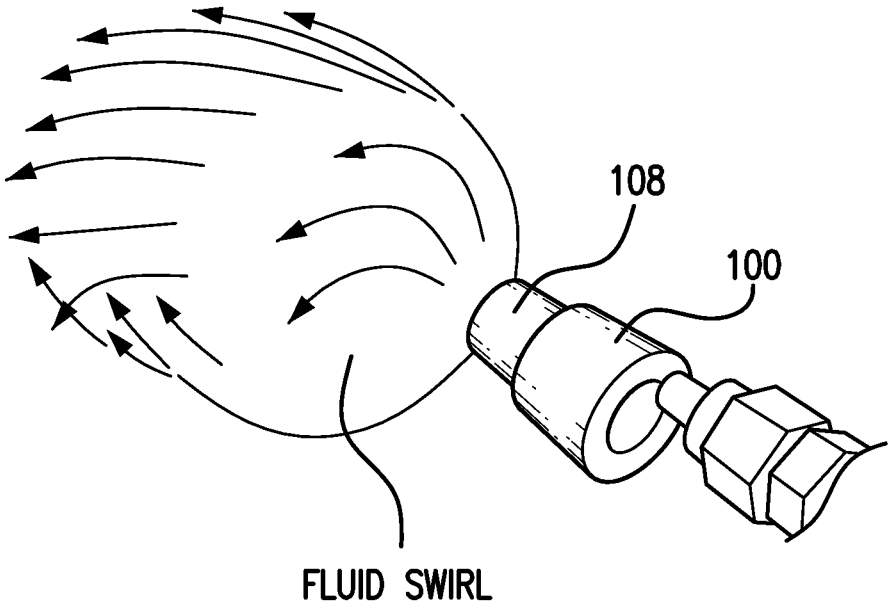
FIG. 4 is an end perspective view of the fuel injector of FIG. 1, showing a cone spray pattern produced by the fuel circuits from fuel traversing the fuel injector.

With reference to FIG. 4, fluid flow through fuel injector 100 having nozzle body 102 is shown. Fuel injector 100 includes a prefilmer 108. This allows for air blasting fluid issuing from fuel injector 100. In the illustrated embodiment, a plurality of outlet orifices 114 (shown in FIG. 2) are oriented circumferentially relative to an axis of fuel injector 100. This imparts swirl in the fluid, causing the fluid swirl illustrated in FIG. 4 in the direction of fluid issue from fuel injector 100. It is contemplated that, in certain embodiments, outlet orifices of the fuel circuits are arranged such that fluid issues without a circumferential component, as suitable for an intended application.

Conventional nozzles formed using forging, casting, or machining operations typically meter fuel flow using small area passages. Additive manufacturing can provide certain benefits to nozzle design, such as tolerance for complex internal geometries and/or integration of injector components within the nozzle body. However, some additive manufacturing processes form components with surface finishes that are relatively rough in comparison to other processes, such as investment casting. While suitable for their intended purpose, nozzles formed using processes can require additional operations, like hydro-honing, in order to define internal structures like metering orifices having suitable flow area within the nozzle body for purposes of establishing restricting flow and establishing a predetermined amount of pressure drop in fuel flow traversing the injector.

In embodiments of nozzle bodies and fuel injectors described herein, impingement of the fuel flow within the nozzle body interior fuel circuit restricts fuel flow and causes a pressure drop at the nozzle outlet. In particular, splitting the fuel flow at an upstream location into a branch passage and returning the fuel to the main passage at a downstream location allows for restricting flow through the main passage. This allows for routing the branch passage and/or the main passage within the nozzle body such that the fuel returning from the branch passage to the main passage has a flow component that opposes the direction of fuel through the main passage. It also defines a metering orifice within the nozzle body with an effective flow area that is smaller than the actual flow area of the metering orifice.

Because the actual flow area of the metering orifice is larger than the effective flow area of the metering orifice, the metering orifice is less sensitive to surface roughness, and surface artifacts such as those associated with an additive manufacturing process do not influence flow through the nozzle. Nozzles having such construction can therefore be formed using additive manufacturing process that would otherwise be unsuitable for forming conventional nozzles.

In certain embodiments, fuel injectors described herein can have pressure drop at the outlet orifice caused by impingement of fuel traversing the main passage while having relatively large internal passage flow areas relative to conventional fuel injectors having similar pressure drop due to the passage geometry, e.g. due to passage size or use of a metering orifice. This allows for use of certain types of additive manufacturing techniques that produce surfaces with excessive roughness.

The methods and systems of the present disclosure, as described above and shown in the drawings provide for nozzle bodies and fuel injectors with superior properties including flow rates governed by impinging fuel flows rather than the tolerance of metering apertures defined within the nozzle. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A fuel injector for a gas turbine engine, comprising:
a monolithic nozzle body defining therein at least one fuel circuit, the at least one fuel circuit including:
an inlet and an outlet orifice;
a main passage fluidly coupling the inlet and the outlet orifice; and
a branch passage connected to the main passage,
wherein the branch passage diverges from the main passage downstream of the inlet, wherein the branch passage converges with and joins the main passage upstream of the outlet orifice, and wherein the branch passage connects to the main passage downstream of the inlet and upstream of the outlet orifice to form an effective metering flow area that is smaller than a flow area of the outlet orifice.

2. The fuel injector as recited in claim 1, wherein the branch passage includes an arcuate segment with an axial component oriented toward the nozzle body inlet.

3. The fuel injector as recited in claim 1, wherein the branch passage rejoins the main passage at an angle opposing a direction of flow through the main passage.

4. The fuel injector as recited in claim 1, wherein the branch passage diverges from the main passage at a diverging junction, wherein a segment of the main passage upstream and adjacent to the diverging junction is coaxial with a segment of the branch passage downstream and adjacent to the diverging junction.

5. A The fuel injector as recited in claim 4, wherein flow axes defined by a segment of the main passage downstream and adjacent to the diverging junction and the segment of the diverging passage downstream of the diverging junction intersect one another at an acute angle.

6. The fuel injector as recited in claim 1, wherein the branch passage rejoins the main passage at a converging junction, wherein a flow axis defined by the branch passage upstream an adjacent to the converging junction intersects a flow axis defined by the main passage upstream and adjacent to the converging junction at an obtuse angle .

7. The fuel injector as recited in claim 6, wherein the branch passage flow axis has a component that opposes the main passage flow axis through a segment of the main passage adjacent to and upstream of the converging junction.

8. The fuel injector as recited in claim 1, further including a distribution header fluidly coupling the inlet with the main passage of the fuel circuit.

9. The fuel injector as recited in claim 1, wherein the main passage fluidly couples the branch passage with both the inlet and outlet orifice of the nozzle body.

10. The fuel injector as recited in claim 1, wherein the fuel circuit is a first fuel circuit, and further including a second fuel circuit, wherein the second fuel circuit connects the inlet to a second outlet orifice.

11. A fuel injector for a gas turbine engine, comprising:
a prefilmer; and
a monolithic nozzle body disposed within the prefilmer and defining within its interior at least one fuel circuit, the at least one fuel circuits including:
an inlet and an outlet orifice;
a main passage fluidly coupling the inlet and the outlet orifice; and
a branch passage connected to the main passage, wherein the branch passage diverges from the main passage downstream of the inlet,
wherein the branch passage converges with and joins the main passage upstream of the outlet orifice, and wherein the branch passage connects to the main passage downstream of the inlet and upstream of the outlet orifice to form an effective metering flow area that is smaller than a flow area of the outlet orifice.

12. The fuel injector as recited in claim 11, wherein the main passage fluidly couples a turning segment of the branch passage with both the inlet and outlet orifice of the nozzle body.

13. A fuel injector as recited in claim 11, wherein the fuel circuit is a first fuel circuit, and further including a second fuel circuit, wherein the second fuel circuit connects the inlet to a second outlet orifice.

* * * * *